US012227927B2

(12) United States Patent
Mooren et al.

(10) Patent No.: US 12,227,927 B2
(45) **Date of Patent: *Feb. 18, 2025**

(54) FAUCET WITH ONE-PIECE TRIM

(71) Applicant: Kohler Co., Kohler, WI (US)

(72) Inventors: Brian J. Mooren, Sheboygan Falls, WI (US); Andrew J. Rieth, Howards Grove, WI (US)

(73) Assignee: KOHLER CO., Kohler, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/453,064

(22) Filed: Aug. 21, 2023

(65) Prior Publication Data

US 2024/0044117 A1 Feb. 8, 2024

Related U.S. Application Data

(63) Continuation of application No. 17/366,789, filed on Jul. 2, 2021, now Pat. No. 11,732,448, which is a continuation of application No. 16/447,040, filed on Jun. 20, 2019, now Pat. No. 11,060,267.

(60) Provisional application No. 62/689,532, filed on Jun. 25, 2018.

(51) Int. Cl.
*E03C 1/04* (2006.01)

(52) U.S. Cl.
CPC ..... *E03C 1/0402* (2013.01)

(58) Field of Classification Search
CPC ..... E03C 1/0402
USPC ..... 4/678
See application file for complete search history.

(56) References Cited

U.S. PATENT DOCUMENTS

| | | | | |
|---|---|---|---|---|
| 4,356,574 | A | 11/1982 | Johnson | |
| 5,131,428 | A * | 7/1992 | Bory | E03C 1/0403 251/366 |
| 6,138,296 | A | 10/2000 | Baker | |
| 6,792,629 | B2 | 9/2004 | Nelson | |
| 7,055,545 | B2 | 6/2006 | Mascari et al. | |
| 7,490,619 | B2 | 2/2009 | Farag et al. | |

(Continued)

FOREIGN PATENT DOCUMENTS

| | | |
|---|---|---|
| CN | 2777304 Y | 5/2003 |
| CN | 102007330 A | 4/2011 |

(Continued)

OTHER PUBLICATIONS

Chinese Office Action CN Application No. 201910541825.7 dated Nov. 11, 2020 (37 pages).

(Continued)

*Primary Examiner* — Huyen D Le
(74) *Attorney, Agent, or Firm* — FOLEY & LARDNER LLP

(57) ABSTRACT

A faucet trim assembly includes faucet body subassembly and a base subassembly removably coupled to the faucet body subassembly. The faucet body subassembly includes a spout, an escutcheon coupled to the spout, and a handle coupled to the escutcheon. The spout includes a first internal passageway. The base subassembly includes a valve cartridge that is removably coupled to the base subassembly. The valve cartridge is configured to control a flow of water through the spout. The base subassembly is configured to removably couple to a sink deck independently from the faucet body subassembly.

20 Claims, 8 Drawing Sheets

(56) References Cited

U.S. PATENT DOCUMENTS

| | | | | |
|---|---|---|---|---|
| 7,979,929 | B2 | 7/2011 | Vogel | |
| 8,407,828 | B2 * | 4/2013 | Vogel | E03C 1/23 4/678 |
| 8,695,625 | B2 | 4/2014 | Marty et al. | |
| 8,931,500 | B2 | 1/2015 | Thomas | |
| 9,499,960 | B2 | 11/2016 | Zhu et al. | |
| 9,957,698 | B2 | 5/2018 | Pitsch et al. | |
| 11,060,267 | B2 * | 7/2021 | Mooren | E03C 1/0402 |
| 11,732,448 | B2 * | 8/2023 | Mooren | E03C 1/0401 4/678 |
| 2004/0154673 | A1 | 8/2004 | Mascari et al. | |
| 2006/0200904 | A1 | 9/2006 | Vogel et al. | |
| 2007/0044232 | A1 | 3/2007 | McNerney et al. | |
| 2007/0044852 | A1 | 3/2007 | Pinette | |
| 2012/0067978 | A1 | 3/2012 | Leichty et al. | |
| 2013/0248005 | A1 | 9/2013 | Pitsch et al. | |
| 2015/0308087 | A1 | 10/2015 | Zhu et al. | |
| 2022/0290417 | A1 * | 9/2022 | Currey | E03C 1/04 |

FOREIGN PATENT DOCUMENTS

| | | |
|---|---|---|
| CN | 206037430 U | 3/2017 |
| CN | 106802176 A | 6/2017 |
| EP | 0 808 952 | 9/2003 |

OTHER PUBLICATIONS

Chinese Second Office Action CN Patent Application No. 201910541825.7 dated May 25, 2021 (9 pages).

Cleveland Faucet Group; Full Line Price Catalog 2015-2016; Feb. 1, 2015; 80 pages.

Non-Final Office Action on U.S. Appl. No. 16/447,040 DTD Oct. 27, 2020.

Non-Final Office Action on U.S. Appl. No. 17/366,789 DTD Dec. 13, 2022.

Notice of Allowance on U.S. Appl. No. 16/447,040 DTD Mar. 16, 2021.

Notice of Allowance on U.S. Appl. No. 17/366,789 DTD Apr. 6, 2023.

* cited by examiner

FAUCET WITH ONE-PIECE TRIM

CROSS-REFERENCE TO RELATED PATENT APPLICATIONS

This application is a continuation of U.S. patent application Ser. No. 17/366,789, filed Jul. 2, 2021, which is a continuation of U.S. patent application Ser. No. 16/447,040, filed Jun. 20, 2019 (now U.S. Pat. No. 11,060,267), which claims the benefit of and priority to U.S. Provisional Patent Application No. 62/689,532, filed Jun. 25, 2018, the entire disclosures of which are hereby incorporated by reference in their entireties.

BACKGROUND

The present disclosure relates generally to the field of faucets. More specifically, the present disclosure relates to a faucet trim assembly which is configured to detachably couple to a water source using a fastener.

SUMMARY

One embodiment relates to a faucet trim assembly. The faucet trim assembly includes faucet body subassembly and a base subassembly removably coupled to the faucet body subassembly. The faucet body subassembly includes a spout, an escutcheon coupled to the spout, and a handle coupled to the escutcheon. The spout includes a first internal passageway. The base subassembly includes a valve cartridge that is removably coupled to the base subassembly. The valve cartridge is configured to control a flow of water through the spout. The base subassembly is configured to removably couple to a sink deck independently from the faucet body subassembly.

In some exemplary embodiments, the spout and the handle are integrally formed with the escutcheon without the use of external fasteners.

In some exemplary embodiments, the faucet body subassembly is removably coupled to the base subassembly with only one fastener. The base subassembly may include a yoke. The fastener may be disposed on the escutcheon along a back side of the faucet trim assembly. The fastener may extend downwardly from the escutcheon and into the yoke. In some implementations, the yoke includes a coupler and a plurality of horizontal internal passageways fluidly coupled to the coupler. The faucet body subassembly may include a connector that extends from a lower surface of the spout. The coupler may be sealingly engaged with the connector. In some implementations, the valve cartridge is one of a plurality of valve cartridges. Each one of the plurality of horizontal internal passageways may be fluidly coupled to a corresponding one of the plurality of valve cartridges.

In some exemplary embodiments, the base subassembly includes a yoke and an elongate member coupled to the yoke. The elongate member may be configured to removably couple the base subassembly to the sink deck. In some implementations, the elongate member includes a second internal passageway configured to fluidly couple the valve cartridge to a water supply.

In some exemplary embodiments, the valve cartridge is one of a plurality of valve cartridges. The plurality of valve cartridges may include a hot water valve cartridge configured to control a flow of hot water and a cold water valve cartridge configured to control a flow of cold water. The handle may be one of two handles coupled to the escutcheon on opposing ends of the escutcheon. A first handle of the two handles may operably engage with the hot water valve cartridge and a second handle of the two handles may operably engage with the cold water valve cartridge.

Another embodiment relates to a base subassembly. The base subassembly includes a yoke, a valve cartridge, and an elongate member. The valve cartridge is removably coupled to the yoke and configured to control a flow of water. The elongate member is coupled to the yoke and configured to removably couple the base subassembly to a sink deck. The yoke is configured to removably couple the base subassembly to a faucet body subassembly and also to fluidly couple the base subassembly to the faucet body subassembly.

In some exemplary embodiments, the yoke is configured to removably couple the base subassembly to the faucet body subassembly with only one fastener. In some implementations, the yoke includes a threaded bore configured to receive the fastener. The threaded bore may be oriented at an approximately 45 degree angle relative to a lower surface of the yoke.

In some exemplary embodiments, the yoke includes a coupler and a plurality of horizontal internal passageways fluidly coupled to the couple. The coupler may be configured to fluidly couple the base subassembly to a spout of the faucet body subassembly. In some implementations, the valve cartridge is one of a plurality of valve cartridges. Each one of the plurality of horizontal internal passageways may be fluidly coupled to a corresponding one of the plurality of valve cartridges.

In some exemplary embodiments, the elongate member includes an internal passageway. The internal passageway may be configured to fluidly couple the valve cartridge to a water supply.

In some exemplary embodiments, the valve cartridge is one of a plurality of valve cartridges coupled to the yoke on opposing ends of the yoke. The plurality of valve cartridges may include a hot water valve cartridge configured to control a flow of hot water and a cold water valve cartridge configured to control a flow of cold water.

Another embodiment is a method of installing a faucet trim assembly. The method includes mounting a base subassembly to a sink deck, positioning a faucet body subassembly over the base subassembly such that the base subassembly is at least partially received within the faucet body subassembly, and coupling the faucet body subassembly to the base subassembly. The base subassembly may include a valve cartridge that is removably coupled to the base subassembly.

In some exemplary embodiments, coupling the base subassembly to the faucet body subassembly includes providing one fastener and threadably engaging the one fastener with both the faucet body subassembly and the base subassembly.

In some exemplary embodiments, the base subassembly includes a plurality of elongate members. Mounting the base subassembly to the sink deck may include positioning each of the plurality of elongate members through a corresponding one of a plurality of openings in the sink deck and applying a clamping member to a lower end of each one of the plurality of elongate members.

In some exemplary embodiments, the method further includes integrally coupling a lower surface of a spout to an upper surface of an escutcheon to form the faucet body subassembly.

DETAILED DESCRIPTION

Prior to turning to the figures, which illustrate the exemplary embodiments in detail, it should be understood that the present disclosure is not limited to the details or methodology set forth in the description or illustrated in the figures. It should also be understood that the terminology used herein is for the purpose of description only and should not be regarded as limiting.

One common type of sink configuration is a centerset sink. Centerset sinks are generally configured to have two handles (i.e., one configured to control the flow of hot water and the other to control the flow of cold water) and a spout therebetween. The spout generally will have an internal passageway and a mixing area, such that water can flow from a water supply source, through the respective hot and cold water flows, and combine in the mixing area before exiting the faucet via a water outlet in the spout.

A valve cartridge may be disposed in each of the handles, which controls the water supply. However, because the cartridges must intermittently be replaced, codes generally require that the cartridges be accessibly by a user. In order to achieve this, some faucets have been configured such that each handle must be individually disassembled to gain access to the cartridge. Some other conventional designs have addressed this by designing removable handles which require either a bonnet that threads onto a yoke, or a set screw connection to a valve stem, which may screw into the top of the valve stem and may include a plug button to cover the screw. However, these type of designs often resulted in an unsightly visible fastener or two-piece threaded design to couple the handle to the valve. Also, with some of these designs the gap between the handle and escutcheon could be inconsistent, which could allow the handle to feel loose or wobbly during normal use. In addition, this type of design may be cumbersome and time consuming to remove, since each handle must be uninstalled and removed separately. Therefore, it is an objective of the present disclosure to provide a faucet trim assembly which offers a clean handle aesthetic (i.e., less gaps or seams) without any exposed fasteners, and access to the yoke for valve replacement with the removal of just one fastener that is inconspicuously disposed on a back side of the escutcheon or faucet assembly.

Figure 1:
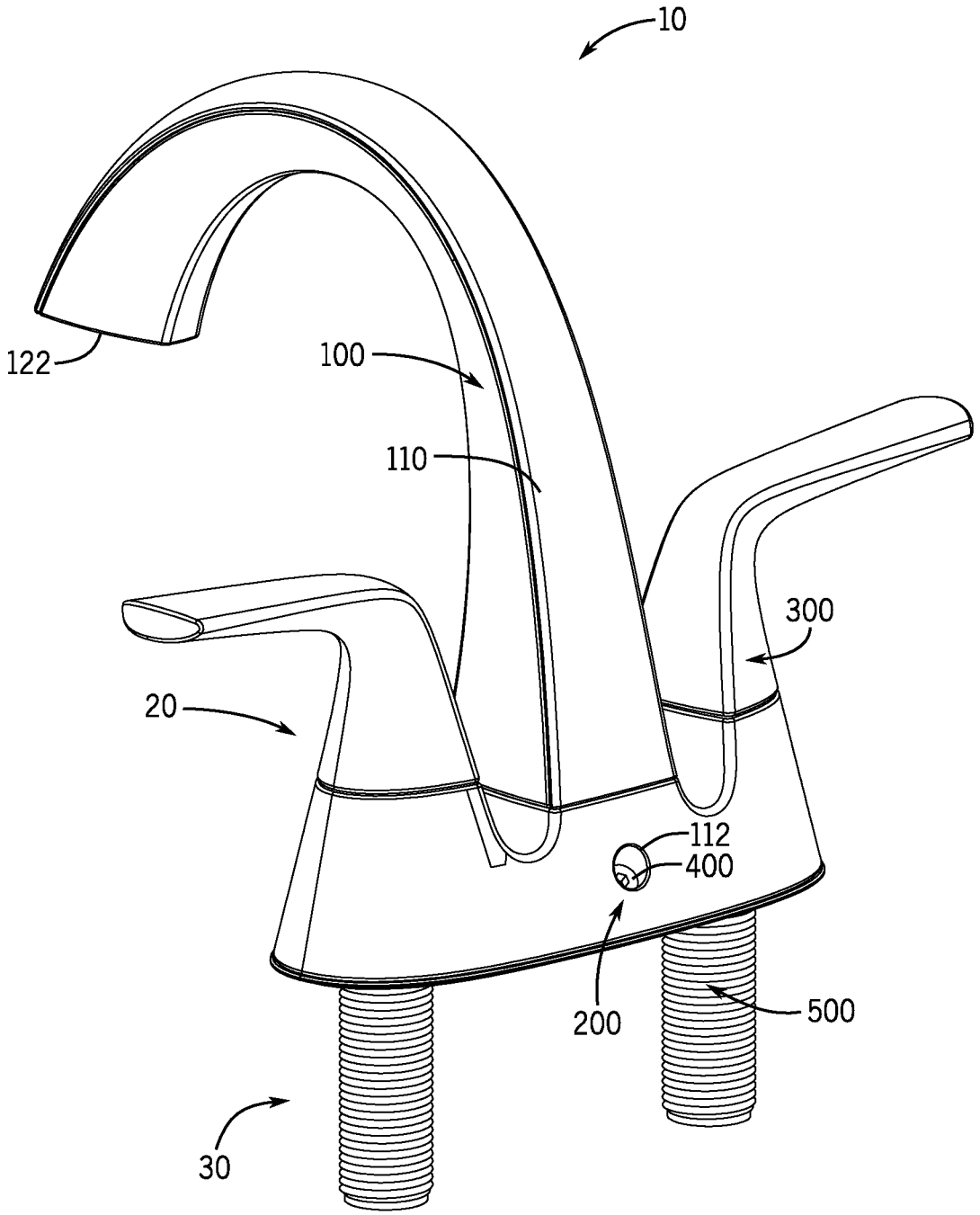
FIG. 1 is a perspective view of the faucet trim assembly, according to an exemplary embodiment.
Figure 2:
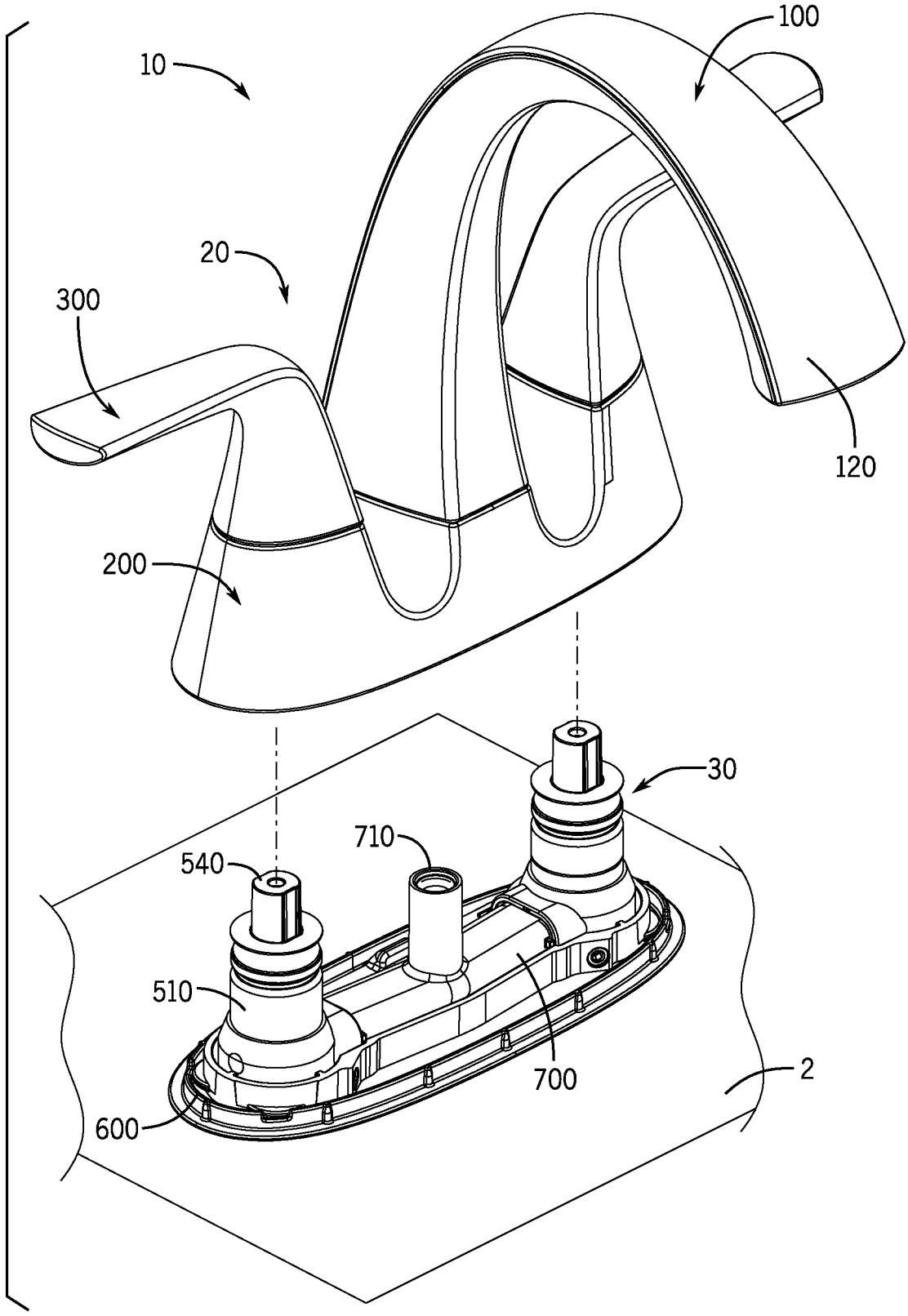
FIG. 2 is a perspective view of the faucet trim assembly of FIG. 1, with the faucet body subassembly removed to show the base subassembly in greater detail.

Referring generally to the Figures, and particularly with reference to FIGS. 1-2, a faucet trim assembly 10 is shown, which includes a faucet body subassembly 20 and a base subassembly 30. The faucet body subassembly 20 may include a spout 100, an escutcheon 200, and at least one handle 300. The faucet body subassembly 20 may be coupled to a yoke 700 of the base subassembly 30 by way of a downwardly extending fastener 400 which extends into a back side 110 of the faucet body subassembly 20. Beneficially, the spout 100 and escutcheon 200 may be integrally formed (e.g., without the use of external fasteners), and may couple to the handles 300 before installation. In a preferred embodiment, the handles 300 may also be integrally formed (e.g., without the use of external fasteners) with the spout 100 and escutcheon 200. Designing the faucet trim assembly 10 to have at least some of the components of the faucet body subassembly 20 integrally formed may beneficially allow for a visually appealing aesthetic, by reducing the amount of seams or gaps that are visible to a user. In addition, such gaps between an escutcheon and handles may cause water to leak over time, so the present disclosure may also help minimize such a concern. In addition, having the handles 300 integrally formed with the escutcheon 200 may advantageously reduce the required cross section (e.g., size) of the faucet trim assembly 10, since fewer fasteners will be required.

Figure 3:
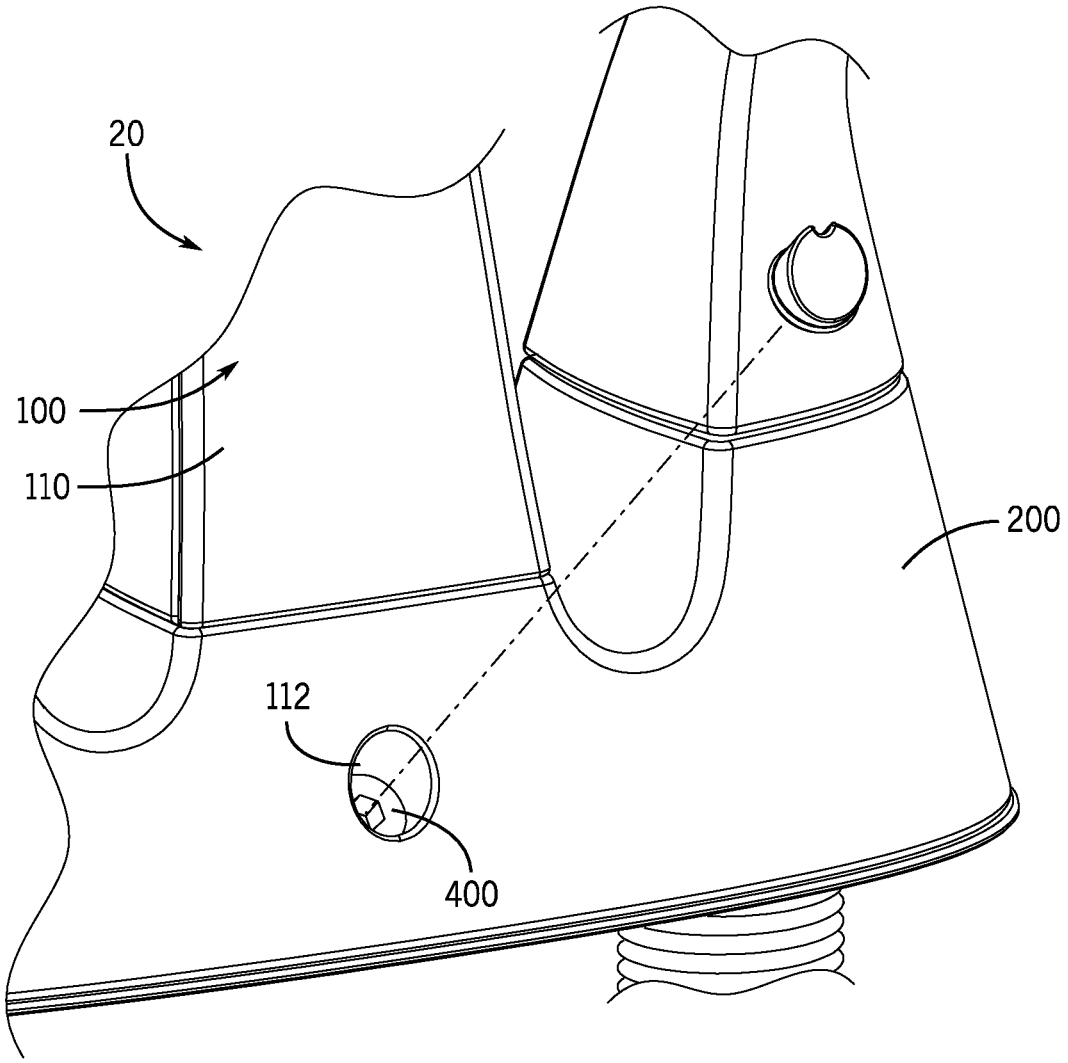
FIG. 3 is a perspective view of the faucet trim assembly of FIG. 1, showing the back side of the spout and escutcheon.

FIGS. 1-2 illustrate a faucet trim assembly 10 that can be mounted on a surface 2 (e.g., a sink deck or counter top proximate to a sink) and which includes a faucet body subassembly 20 and a base subassembly 30. The faucet body subassembly 20 is shown to include a spout 100, an escutcheon 200, two handles 300, and a fastener 400. The spout 100 is generally vertically extending (e.g., in a substantially perpendicular orientation relative to a sink deck or counter top surface) and has a back side 110 and a front side 120, where the front side 120 extends forward (e.g., in a substantially parallel orientation relative to a sink deck or counter top surface) and has a water outlet 122 disposed on a lower surface thereof. The spout 100 also includes an internal passageway which fluidly couples a water source to the water outlet 122, such that water may flow from the water source, through the lower end of the faucet trim assembly 10 upward, and exit through the water outlet 122. Referring generally to FIG. 3, the faucet body subassembly 20 includes a downwardly extending bore 112 disposed in the escutcheon 200 proximate to the back side 110 of the spout 100. The bore 112 is configured to receive the fastener 400. In this way, the faucet body subassembly 20 may be removably coupled (e.g., detachably coupled) to the base subassembly 30 by way of the fastener 400. In particular, the bore 112 may be threaded and may extend inward and downward through the escutcheon 200 at approximately a 45 degree angle. The fastener 400 may also be threaded, such that the fastener 400 may threadably engage with the bore 112. Due to the angle of the bore 112 and fastener 400, the fastener 400 may be substantially received within the bore 112, such that it is inconspicuously positioned on the back side 110 of the faucet trim assembly 10. Though the bore 112 is shown in a back side of the escutcheon 200, it should be appreciated that the bore 112 could alternatively be disposed in the back side 110 of the spout 100. In addition, while the fastener 400 is shown as a screw, it should be appreciated that any other similar fastener may be used.

Figure 4:
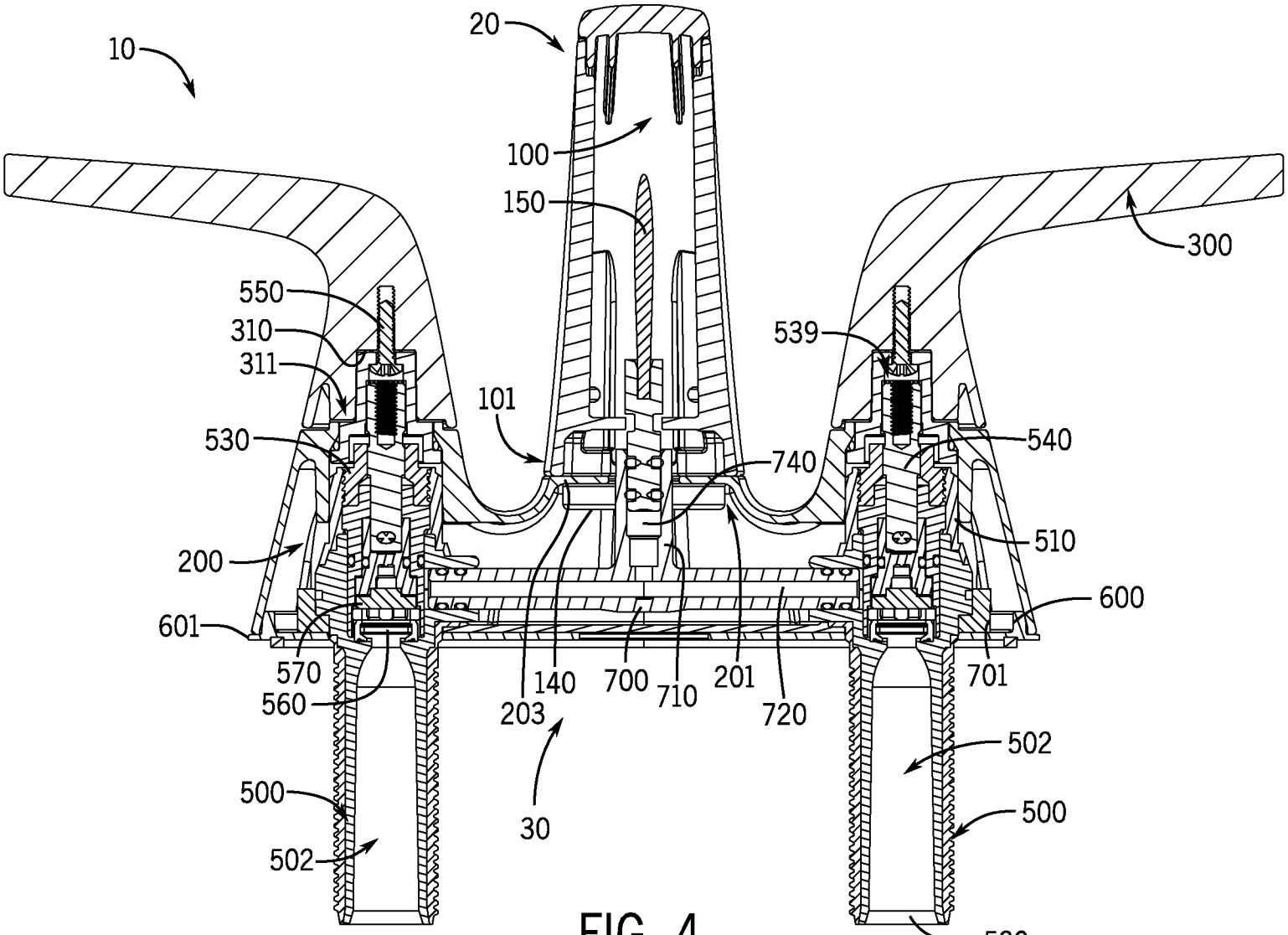
FIG. 4 is a front cross sectional view of the faucet trim assembly shown in FIG. 1.

Referring now to FIG. 4, the faucet body subassembly 20 may be configured such that a lower end 101 of the spout 100 is coupled to an upper surface 201 of the escutcheon 200, and a handle 300 may be disposed on the upper surface 201 at either end of the escutcheon 200. The flowlines and profile of the spout 100, escutcheon 200, and handles 300 may correlate, such that they all appear as one body, without obvious seams, steps, or gaps. In some embodiments, the spout 100 and escutcheon 200 may be integrally formed as a single unitary structure. In FIG. 4, the spout 100 is shown fixedly coupled to the escutcheon 200 by way of fasteners 140 which extend upwardly from a top inner surface 203 of the escutcheon 200 into the lower end 101 of the spout 100 (e.g., through a lower surface of the spout 100). The handles 300 may couple to the escutcheon 200 by way of, for example, fasteners received within the handle 300 or a press fit connection (e.g., a lip within the handle 300 that snaps in place to couple to the escutcheon 200). In a preferred embodiment, both the handles 300 and the spout 100 may be coupled to the escutcheon 200 before being installed (e.g., during manufacturing). It should be appreciated that by assembling the faucet body subassembly 20 (e.g., the spout 100, escutcheon 200, and handles 300) as a unitary body prior to installing, the components may all easily be handled together.

The handles 300 may rotatably couple to the escutcheon 200 such that the handles 300 may rotate relative to the escutcheon 200. The handles 300 may each include a recess 310 extending upward from a bottom side 311, which may be configured to at least partially receive a valve cartridge 540. Each handle 300 and valve cartridge 540 may control a respective water supply. For example, the left handle 300 may be configured to control the hot water supply, such that a user may rotate the left handle 300 to adjust the flow of hot water out of the faucet trim assembly 10. Similarly, the right handle 300 may be configured to control the cold water supply, such that a user may rotate the right handle 300 to adjust the flow of cold water out of the faucet trim assembly 10.

The base subassembly 30 is shown to include a plurality of downwardly extending elongate members 500, a base plate 600, a yoke 700, a coupler 710 that is at least partially received in the yoke 700, and a pair of valve cartridges 540. A bottom surface of the yoke 700 may abut a top surface of the base plate 600, such that the yoke 700 is coupled to the base plate 600. The yoke 700 and base plate 600 are each shown to extend longitudinally (e.g., parallel to a sink deck or counter top surface, left-to-right as shown in FIG. 4). As shown in FIG. 4, an outer perimeter 701 of the yoke 700 is smaller than an outer perimeter 601 of the base plate 600. In some embodiments, the base plate 600 and yoke 700 may be integrally formed as a single, unitary piece.

Figure 5:
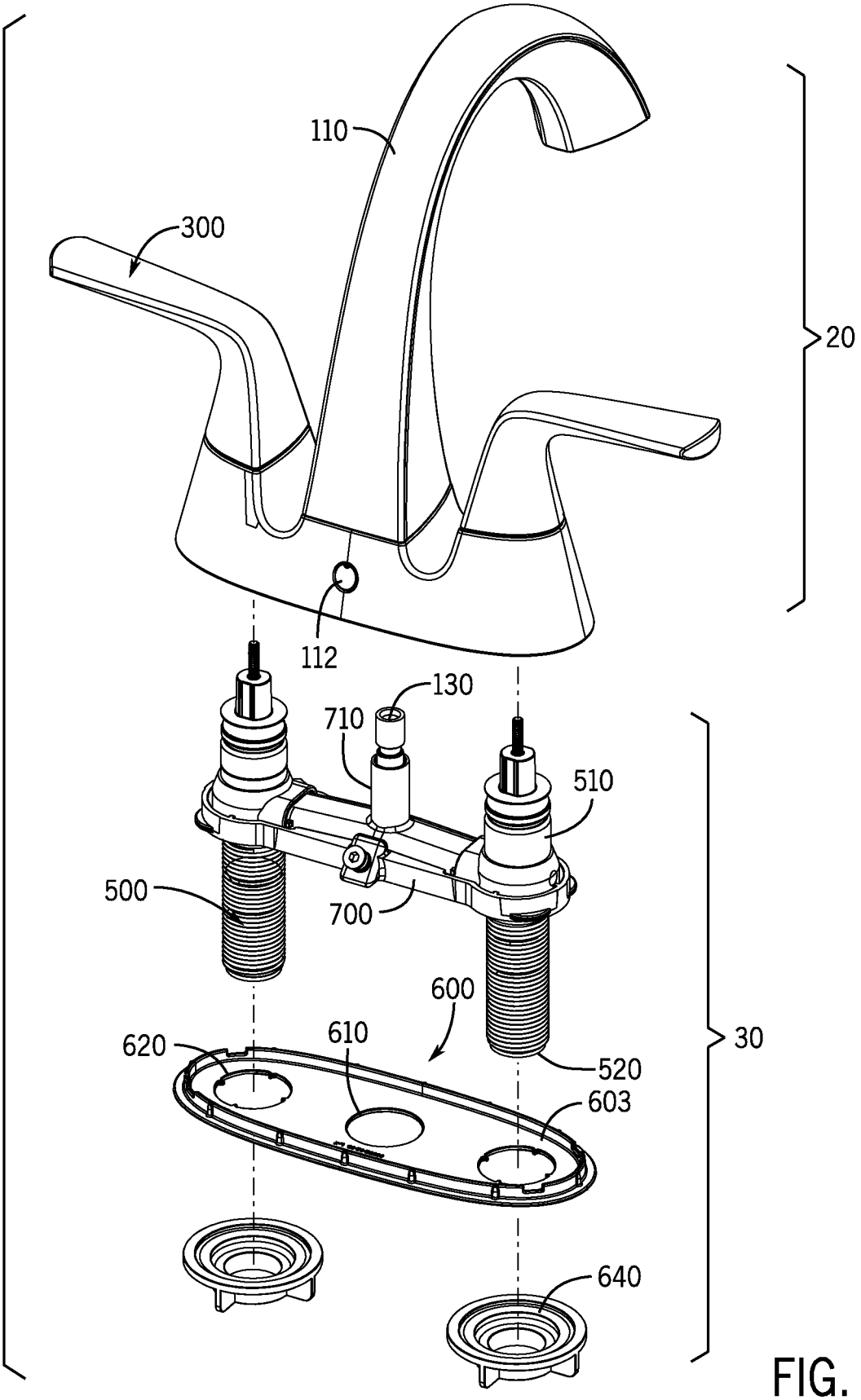
FIG. 5 is a partially disassembled view of the faucet trim assembly of FIG. 1.

The elongate members 500 extend vertically downward and include an internal passageway 502 which fluidly connects an upper end 510 of the elongate member 500 to a lower end 520 of the elongate member 500. The elongate members 500 may be threaded on an outer surface, such that they are configured to threadably engage with other threaded components. The lower end 520 of the elongate members 500 may fluidly couple to a water source. For example, the internal passageway 502 of the left elongate member 500 may fluidly couple with a water supply to control the hot water, and the internal passageway 502 of the right elongate member 500 may fluidly couple with a water supply to control the cold water. Referring now to FIG. 5, the elongate members 500 are shown to couple to the yoke 700 (e.g., through a vertically extending, throughgoing aperture at either end of the yoke 700, not shown). As shown in FIGS. 4-5, the elongate member 500 may threadably couple to the yoke 700 such that the upper end 510 of the elongate member 500 may be disposed above the yoke 700 and the lower end 520 of the elongate member 500 may extend downward below the yoke 700.

As shown in FIG. 5, the base plate 600 may have a substantially rectangular cross section, and may include two first apertures 620 at either end of the base plate 600, and a second aperture 610 therebetween. The first apertures 620 may have a circular cross section and may have a radius that is at least as large as the outer radius of the elongate members 500. The first apertures 620 may concentrically align with apertures of the yoke 700 and with the elongate members 500, such that the elongate members 500 may each be received within an aperture of the yoke 700 and an aperture 620 of the base plate 600 (see also FIG. 4). In some embodiments, rather than the elongate member 500 threadably engaging with the yoke 700, the elongate member 500 and yoke 700 may be integrally formed as a single unitary structure. In addition, the base subassembly 30 may further include a pair of clamping members 640 which are disposed below the base plate 600. The clamping members 640 may be annular rings having a threaded internal bore which may threadably engage with the elongate members 500. Specifically, during installation, the base plate 600 may be positioned over throughgoing holes of a sink deck or countertop 2 (see FIG. 2). The yoke 700 may couple to a top surface 603 of the base plate 600, and the elongate members 500 may extend downwardly through the yoke 700, the apertures 620 of the base plate 600, and the holes of the sink deck or countertop 2. The lower end 520 of the elongate members 500 may extend below the sink deck or countertop 2, and may fixedly couple to the clamping members 640. The clamping members 640 thus may abut a lower surface of the sink deck or countertop 2 to ensure that the base plate 600 and yoke 700 are affixed to the sink deck or countertop 2.

Referring again to FIG. 4, the faucet trim assembly 10 is shown to include a horizontal internal passageway 720 disposed within the yoke 700. The horizontal internal passageway 720 may fluidly couple the internal passageway 150 of the spout 100 with the internal passageway 502 of the elongate members 500. In this way, water may flow upwards from a water source through the internal passageway 502 of the elongate members 500, across through the horizontal internal passageway 720 of the yoke 700, and upward through the internal passageway 150 of the spout 100 before exiting the faucet trim assembly 10 through the water outlet 122 (see also FIG. 1).

The base subassembly 30 is shown to include a valve cartridge 540 received at least partially within an upper end 510 of each elongate member 500. An O-ring 560 or other sealing member may be disposed below (e.g., vertically below, upstream of) the valve cartridge 540 within the elongate member 500. The O-ring 560 may at least partially form a pocket 570 in a lower end of the valve cartridge 540 that fluidly connects the internal passageway 502 of the elongate member 500 to the horizontal internal passageway 720 of the yoke 700. When assembled, each valve cartridge 540 may be at least partially received within the recess 310 of the handle 300 and the upper end 510 of the elongate member 500. In some embodiments, a bonnet 530 may be disposed between the handle 300 and the elongate member 500 and partially receive the valve cartridge 540. The bonnet 530 may threadably engage with the elongate member 500 to fixedly position the valve cartridge 540 with respect to the elongate member 500. A limit stop 550 may be installed in the recess 310 of the handle 300 and abut an upper end 539 of the valve cartridge 540. The limit stop 550 may operably engage with the valve cartridge 540 such that, in operation, when a user rotates the handle 300, it will control the position of the valve cartridge 540, and thus, the flow of water.

Figure 6:
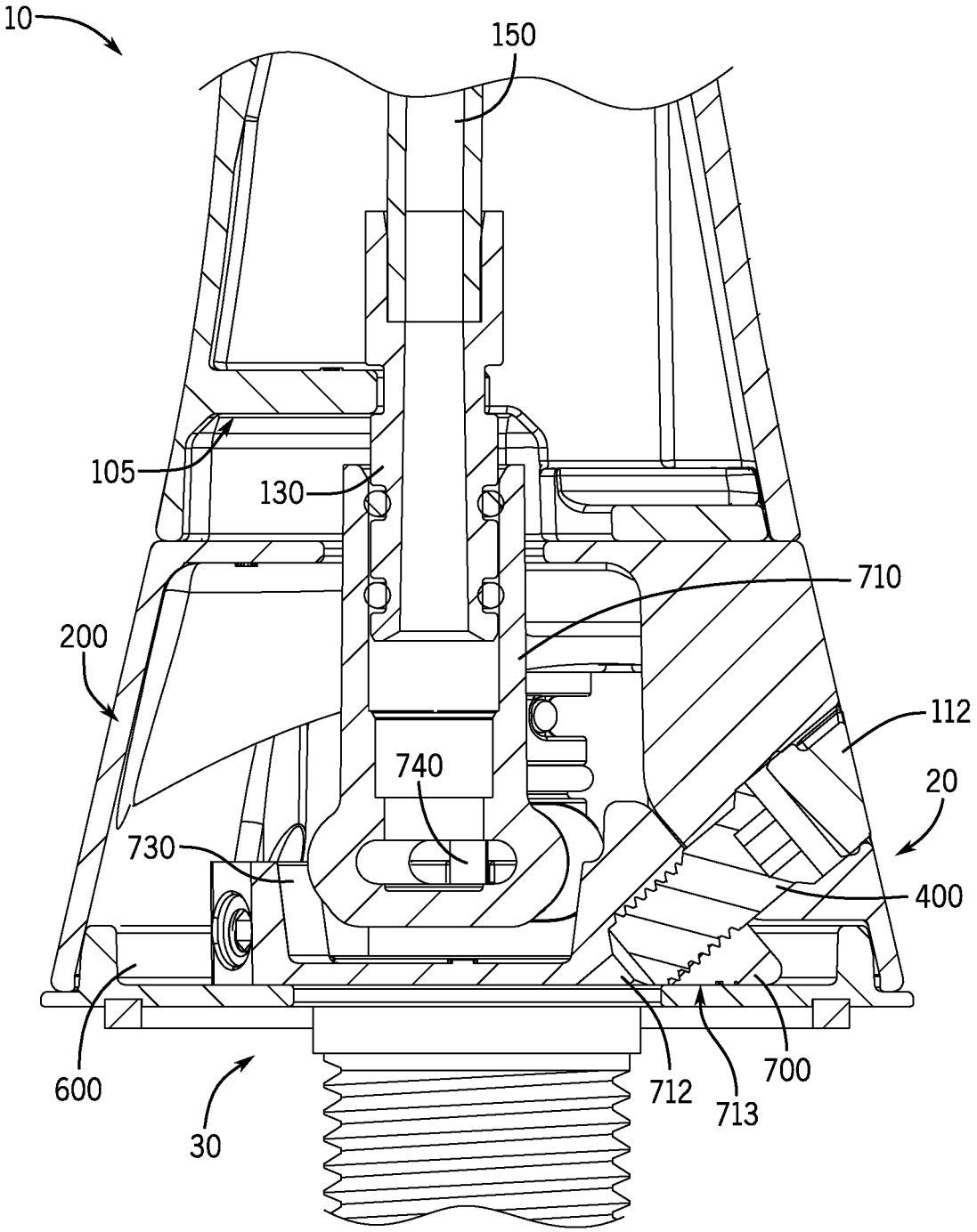
FIG. 6 is a side cross sectional view of the faucet trim assembly of FIG. 1 to show the fastener positioning and mixing area in greater detail.

Referring now to FIG. 6, when assembled, the horizontal internal passageways 720 of the yoke 700 may fluidly couple with the internal passageway 150 of the spout 100 in the mixing area 740. Specifically, a coupler 710 (see also FIG. 4) may be received within a recess 730 of the yoke 700 which may sealingly engage with a connector 130 that extends from a lower surface 105 of the spout 100 and fluidly couples with the internal passageway 150 of the spout 100. In operation, upon a user interfacing with the handles 300, water may be directed from the water supplies, through the internal passageways 502 of the elongate member 500, engage with the respective valve cartridge 540, and flow through the horizontal internal passageways 720 before reaching the mixing area 740. Here, the hot water may combine with the cold water before flowing upwards through the internal passageway 150 of the spout 100 and exiting the water outlet 122 of the faucet trim assembly 10 (see also FIG. 1).

In addition, as shown in FIG. 6, the fastener 400 may extend downwardly into the bore 112 of the faucet body subassembly 20 (e.g., in the escutcheon 200). The fastener 400 may terminate in a threaded bore 712 of the yoke 700. As can be seen, the bore 112 of the faucet body subassembly 20, the fastener 400, and the bore 712 of the yoke 700 may be concentrically aligned and may extend inward and downward from a back side 110 at an approximately 45 degree angle relative to a lower surface 713 of the yoke 700 (e.g., relative to a surface of the sink deck or countertop to which the yoke is coupled). As can be seen, beneficially, such a configuration may significantly reduce the required cross section of the faucet trim assembly 10 (e.g., the size). This may also beneficially allow the fastener 400 to be hidden, inconspicuously, along a back side of the faucet trim assembly 10, and thereby to provide a more seamless and clean aesthetic. Lastly, as described in greater detail below, in the event that a user needs to access the valve cartridges 540 (see FIG. 4), the user may simply remove the fastener 400, at which point the entire faucet body subassembly (e.g., the spout 100, escutcheon 200, and handles 300) may be disengaged from and lifted off of the base subassembly 30 to expose both valve cartridges 540.

In addition, it should be appreciated that a hot water control system of the faucet trim assembly 10 and cold water control system of the faucet trim assembly 10 are structurally and operably identical. In this way, even though, for example, the handle 300, elongate member 500, valve cartridge 540, and all other related components may be described generally, it should be appreciated that a first side of the faucet trim assembly 10 is configured for hot water control and a second side of the faucet trim assembly 10 is configured for cold water control. For example, the left side of the faucet trim assembly 10 as shown in FIG. 4 may be the first side and may be configured to control the hot water control, and accordingly, the valve cartridge 540 that is received in the left handle 300 may be configured for hot water control. Thus, when a user interfaces with the left handle 300 they may control the flow and temperature of the hot water, such that the water may flow from a first water source, through the valve cartridge 540 and horizontal internal passageway 720 from the left side of the faucet trim assembly 10, before reaching the mixing area 740 and flowing upward to exit the faucet trim assembly 10 via the water outlet 122 (see also FIG. 1). In addition, although the faucet trim assembly 10 is shown in various exemplary embodiments as a centerset bathroom sink, the faucet trim assembly 10 disclosed herein may be used with kitchen sinks or any other sink configuration.

Figure 7:
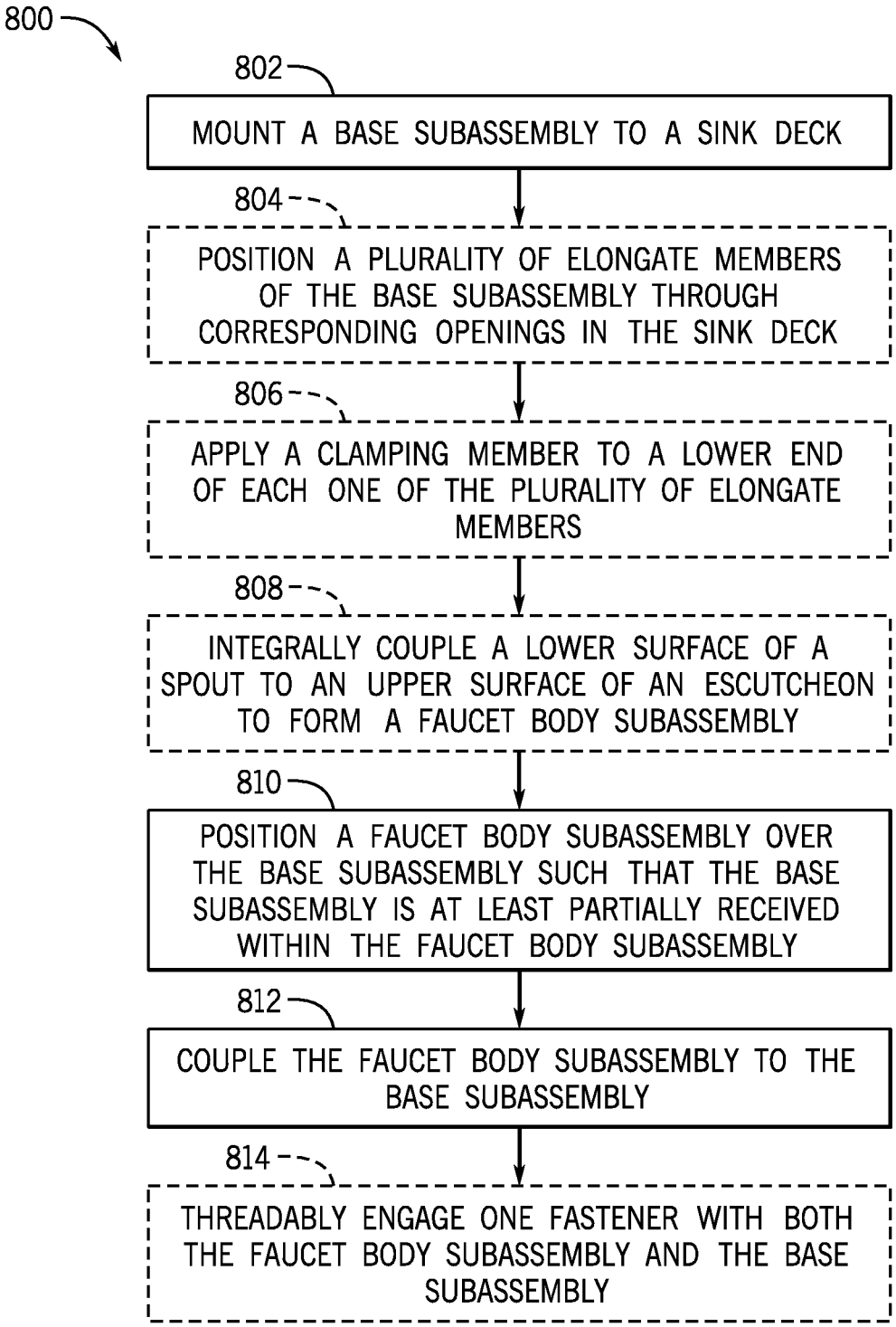
FIG. 7 shows a method of installing the faucet trim assembly to a sink deck or countertop.

A method 800 of installing the faucet trim assembly to a sink deck or countertop is shown in FIG. 7. The faucet trim assembly may be the same or similar to the faucet trim assembly 10 described with reference to FIGS. 1-6. At 802, a base subassembly 30 of the faucet trim assembly 10 is mounted to a sink deck or countertop 2. Operation 802 may further include positioning the elongate members 500 of the base subassembly 30 through corresponding openings (e.g., holes) in the sink deck or countertop 2 (operation 804). The elongate members 500 may be received within and/or threadably engage with the aperture 620 of the base plate 600 and the yoke 700, such that the lower end 520 of the elongate member 500 extends below the sink deck or countertop 2 and the upper end 510 extends above the yoke 700. The clamping members 640 may fixedly couple with the lower end 520 of the elongate members 500, such that the clamping members 640 may abut the lower surface of the sink deck or countertop 2 and bias the yoke 700 and base plate 600 downward.

Operation 802 may further include applying a clamping member 640 (see FIG. 5) to a lower end of each one of the plurality of elongate members 500 (operation 806) and tightening the clamping members 640 such that the sink deck or countertop 2 is sandwiched or otherwise disposed between the yoke 700 and the clamping members 640. In some embodiments, the method 800 additionally includes providing a faucet body subassembly 20 and assembling the faucet body subassembly 20. For example, the faucet body subassembly 20 may be assembled by integrally coupling a lower surface of the spout 100 to an upper surface of the escutcheon 200 by way of upwardly extending fasteners 140 (operation 808). The handles 300 may then be coupled to the escutcheon 200 by way of, for example, a press fit connection. At 810, the faucet body subassembly 20 is positioned over the base subassembly 30 such that the base subassembly 30 is at least partially received within the faucet body subassembly 20. Operation 810 may additionally include positioning the escutcheon 200 over the valve cartridges 540, such that the valve cartridges 540 may be received within the recess 310 of the handles 300, and the coupler 710 may be received between the recess 730 of the yoke 700 and the connector 130 of the spout 100. In this way, the escutcheon 200 will effectively encapsulate the components of the base subassembly 30. At 812 the faucet body subassembly 20 is coupled to the base subassembly 30 by way of the downwardly extending fastener 400 that extends into the bore 112 on the back side of the faucet body subassembly 20. In some implementations, as shown in operation 814, coupling the faucet body subassembly 20 to the base subassembly 30 includes providing one fastener 400 and threadably engaging the one fastener with both the faucet body subassembly 20 and the base subassembly 30.

In the event a user wishes to access the valve cartridges 540, the user may simply remove the fastener 400 from the back surface 110 of the faucet subassembly 20. Once the fastener 400 is removed, the user may pick up the faucet subassembly 20 (i.e., the spout 100, escutcheon 200, and handles 300) to simultaneously expose both valve cartridges 540.

Figure 8:
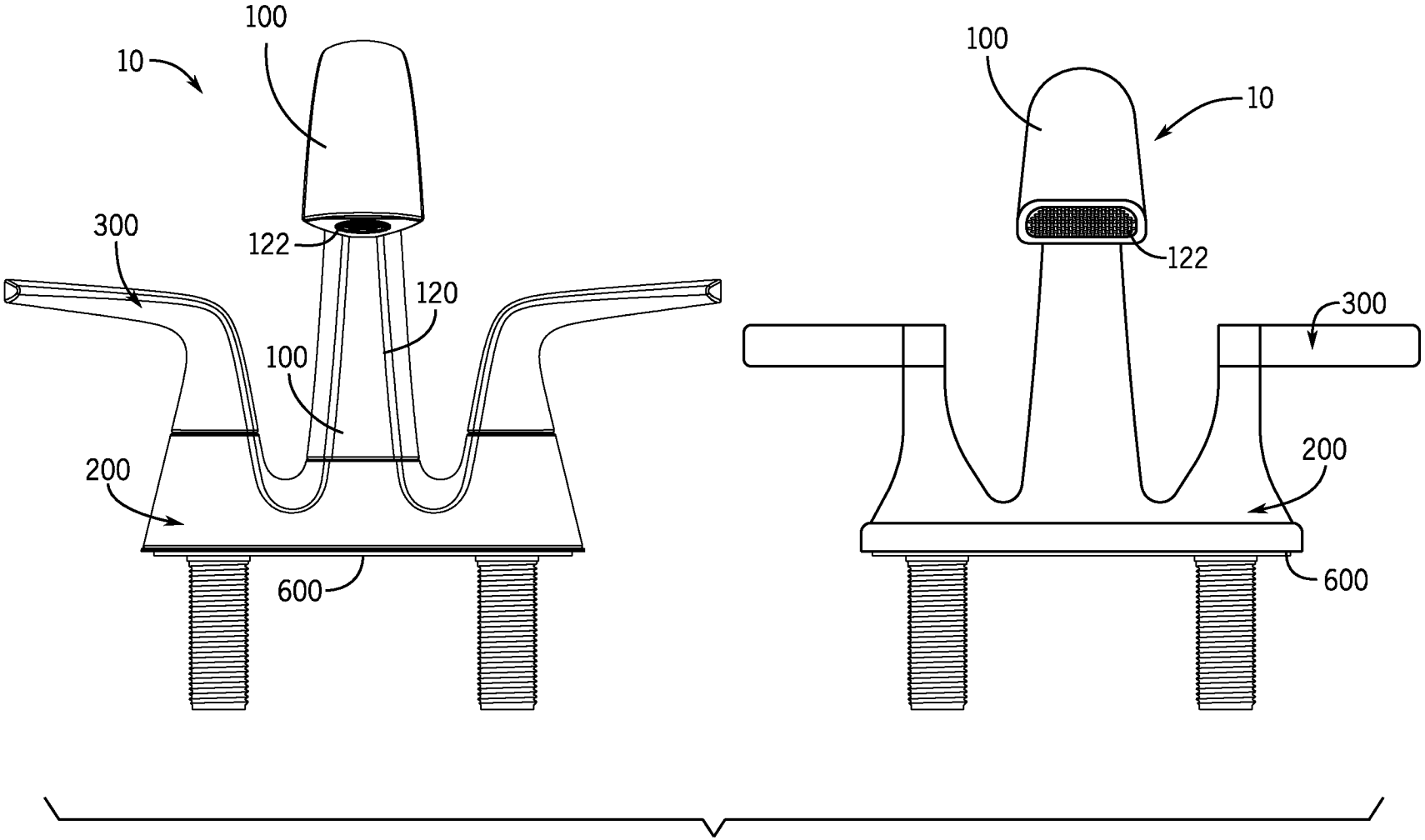
FIG. 8 is a depiction of two different aesthetic styles of the faucet trim assembly of FIG. 1.

Referring now to FIG. 8, two aesthetic styles of the faucet trim assembly 10 are shown. For simplicity, similar number is used to identify similar components. Specifically, the faucet trim assembly 10 shown on the left illustrates a rounded style, where the water outlet 122 has a circular or otherwise round cross section. For the rounded style faucet trim assembly 10, an outer perimeter of the base plate 600 and escutcheon 200 may have, for example, an oblong shape, or may have a generally rectangular cross section with rounded edges. In addition, the handles 300 and spout 100 may also have a rounded profile. Conversely, the faucet trim assembly 10 that is shown to the right has a straighter, squared off style (i.e., where corners are generally closer to 90 degree angles rather than having fillets or other curved profiles), where the water outlet 122 has a generally rectangular cross section. For the squared-off style faucet trim assembly 10, an outer perimeter of the base plate 600 and escutcheon 200 may have, for example, a generally rectangular shape. In addition, the handles 300 and spout 100 may also have a generally squared-off profile. In addition, while these two styles are expressly depicted and described herein, it should be appreciated that any combination of profiles of the faucet trim assembly 10 may be utilized.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, and/or illustrations of possible embodiments (and such terms are not intended to connote that such embodiments are necessarily extraordinary or superlative examples).

The term "coupled," as used herein, means the joining of two members directly or indirectly to one another. Such joining may be stationary (e.g., permanent or fixed) or moveable (e.g., removable or releasable). Such joining may be achieved with the two members coupled to each other, with the two members coupled with a separate intervening member and any additional intermediate members coupled with one another, or with the two members coupled together with an intervening member that is integrally formed as a single unitary body with one of the two members. Such members may be coupled mechanically, electrically, and/or fluidly.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the shelf assembly as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, the position of elements may be reversed or otherwise varied, and the nature or number of discrete elements or positions may be altered or varied. Any element disclosed in one embodiment may be incorporated or utilized with any other embodiment disclosed herein. Although one example of an element that can be incorporated or utilized in another embodiment has been described above, it should be appreciated that other elements of the various embodiments may be incorporated or utilized with any of the other embodiments disclosed herein.

Other substitutions, modifications, changes and omissions may also be made in the design, operating conditions and arrangement of the various exemplary embodiments without departing from the scope of the present invention. For example, any element (e.g., arm, shelf member, fastener, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A faucet trim assembly, comprising:
an escutcheon; and
a handle coupled to the escutcheon without the use of external fasteners between the handle and the escutcheon such that the escutcheon and the handle together form at least part of a single unitary faucet body.

2. The faucet trim assembly of claim 1, further comprising a limit stop that couples the handle to the escutcheon.

3. The faucet trim assembly of claim 2, wherein the limit stop is coupled to the handle by an internal fastener that is accessible from beneath the single unitary faucet body.

4. The faucet trim assembly of claim 1, wherein the escutcheon defines a downwardly extending bore configured to receive a fastener therein to couple a base subassembly to the single unitary faucet body.

5. The faucet trim assembly of claim 1, further comprising a base subassembly disposed at least partially within the single unitary faucet body, the base subassembly comprising a plurality of horizontal internal passageways, the single unitary faucet body coupled to the base subassembly without any internal fasteners.

6. The faucet trim assembly of claim 5, wherein the base subassembly further comprises a plurality of valve cartridges, and wherein each one of the plurality of horizontal internal passageways is fluidly coupled to a corresponding one of the plurality of valve cartridges.

7. The faucet trim assembly of claim 1, further comprising a base subassembly having a removable valve cartridge, wherein the single unitary faucet body is removable from the base subassembly without decoupling the base subassembly from a sink deck.

8. The faucet trim assembly of claim 1, wherein the handle is coupled to the escutcheon via a press fit connection.

9. The faucet trim assembly of claim 1, wherein the handle defines a recess extending upward from a bottom side of the handle, further comprising a fastener extending upwardly through the recess and coupling the handle to the escutcheon.

10. A faucet assembly, comprising:

a faucet body subassembly, comprising:

an escutcheon; and a handle coupled to the escutcheon without any external fasteners; and a base subassembly coupled to the escutcheon separately from the handle, the base subassembly including a valve cartridge.

11. The faucet assembly of claim 10, wherein the base subassembly is configured to be coupled to a sink deck independently from the faucet body subassembly, and wherein the escutcheon must be decoupled from the base subassembly to access the valve cartridge.

12. The faucet assembly of claim 11, wherein the handle defines a recess extending upward from a bottom side of the handle, further comprising a fastener extending upwardly through the recess and coupling the handle to the escutcheon.

13. The faucet assembly of claim 10, wherein the escutcheon defines a downwardly extending bore configured to receive a fastener therein to couple the faucet body subassembly to the base subassembly.

14. The faucet assembly of claim 10, wherein the base subassembly further comprises a plurality of horizontal internal passageways, the faucet body subassembly coupled to the base subassembly without any internal fasteners.

15. The faucet assembly of claim 14, wherein the valve cartridge is one of a plurality of valve cartridges, and wherein each one of the plurality of horizontal internal passageways is fluidly coupled to a corresponding one of the plurality of valve cartridges.

16. The faucet assembly of claim 10, wherein the handle is coupled to the escutcheon via a press fit connection.

17. A method of replacing a valve cartridge in a faucet assembly, comprising:

removing a handle and an escutcheon of the faucet assembly together as a single unitary body from a base subassembly of the faucet assembly;

removing a first valve cartridge from the base subassembly;

engaging a second valve cartridge with the base subassembly; and coupling the single unitary body to the base subassembly.

18. The method of claim 17, wherein removing the single unitary body from the base subassembly further includes lifting the single unitary body away from the base subassembly without decoupling the base subassembly from a sink deck.

19. The method of claim 17, wherein removing the single unitary body from the base subassembly comprises removing a spout of the faucet assembly along with the handle and the escutcheon.

20. The method of claim 17, wherein removing the single unitary body from the base subassembly comprises lifting the single unitary body from the base subassembly without rotating the handle.

* * * * *